US010403967B1

(12) United States Patent
Kim et al.

(10) Patent No.: US 10,403,967 B1
(45) Date of Patent: Sep. 3, 2019

(54) ELECTRONIC DEVICE COMPRISING ANTENNA

(71) Applicant: Samsung Electronics Co., Ltd., Gyeonggi-do (KR)

(72) Inventors: Sung Won Kim, Gyeonggi-do (KR); No Hwan Park, Gyeonggi-do (KR); Ki Sung Bae, Gyeonggi-do (KR); Jun Hee Kim, Gyeonggi-do (KR)

(73) Assignee: Samsung Electronics Co., Ltd., Yeongtong-gu, Suwon-si, Gyeonggi-do (KR)

( * ) Notice: Subject to any disclaimer, the term of this patent is extended or adjusted under 35 U.S.C. 154(b) by 0 days.

(21) Appl. No.: 15/977,196

(22) Filed: May 11, 2018

(30) Foreign Application Priority Data

Mar. 30, 2018 (KR) ..... 10-2018-0037624

(51) Int. Cl.

| | |
|---|---|
| ***H01Q 5/30*** | (2015.01) |
| ***H01Q 1/24*** | (2006.01) |
| ***H01Q 1/48*** | (2006.01) |
| ***H01Q 7/00*** | (2006.01) |

(52) U.S. Cl.
CPC ..... *H01Q 1/243* (2013.01); *H01Q 1/48* (2013.01); *H01Q 5/30* (2015.01); *H01Q 7/00* (2013.01)

(58) Field of Classification Search
CPC .. H01Q 1/24; H01Q 5/30; H01Q 1/48; H01Q 7/00
USPC ..... 343/702
See application file for complete search history.

(56) References Cited

U.S. PATENT DOCUMENTS 9,337,537 B2 5/2016 Hu et al.
2014/0333496 A1* 11/2014 Hu ..... H01Q 1/243 343/745
2017/0201010 A1* 7/2017 Kim ..... H01Q 9/42

FOREIGN PATENT DOCUMENTS

KR 10-2015-0140771 A 12/2015

OTHER PUBLICATIONS

"Galaxy S8, legally to be launched in China on May 18 . . . can Samsung bring back the former glory?" dated May 17, 2017 by Yoo Jinsang reports.

* cited by examiner

*Primary Examiner* — Andrea Lindgren Baltzell
(74) *Attorney, Agent, or Firm* — Cha & Reiter, LLC.

(57) ABSTRACT

An electronic device includes a housing that includes a first plate, a second plate, and a side member, the side member including a first conductive portion, a second conductive portion, a third conductive portion, a first insulating portion, and a second insulating portion, a wireless communication circuitry that is electrically connected to a first point of the first conductive portion, wherein the first point is adjacent to the second insulating portion, a ground member that is included in the housing, a first switching circuitry that includes a first terminal electrically connected to a second point of the first conductive portion, which is more distant from the second insulating portion than the first point, and at least one second terminal electrically connected to the ground member through at least one first passive element, and a conductive pattern that is electrically connected to the second point and forms a closed loop.

20 Claims, 9 Drawing Sheets

ELECTRONIC DEVICE COMPRISING ANTENNA

CROSS-REFERENCE TO RELATED APPLICATION(S)

This application is based on and claims priority under 35 U.S.C. § 119 to Korean Patent Application No. 10-2018-0037624, filed on Mar. 30, 2018, in the Korean Intellectual Property Office, the disclosure of which is incorporated by reference herein its entirety.

BACKGROUND

1. Field

The present disclosure relates to an electronic device that performs a wireless communication by using an antenna.

2. Description of Related Art

Wireless communication technology makes it possible to transmit and receive various forms of information such as a text, an image, a video, voice, and the like. The wireless communication technology is being developed to transmit and receive more information faster. As the wireless communication technology is developed, an electronic device that may support wireless communication may provide a service using a short range communication or long distance communication function.

The above information is presented as background information only to assist with an understanding of the present disclosure. No determination has been made, and no assertion is made, as to whether any of the above might be applicable as prior art with regard to the present disclosure.

SUMMARY

In the case where the electronic device transmits and receives data of a mid-band (1710 MHz to 2170 MHz), the electronic device may switch a matching element connected to a ground part and may shift a frequency band. In this case, a shiftable frequency variation becomes narrow, thereby making a shift to a targeted frequency band difficult (or impossible).

Aspects of the present disclosure are to address at least the above-mentioned problems and/or disadvantages and to provide at least the advantages described below. According to an embodiment of the present disclosure, an electronic device may expand a variation of a transmit/receive frequency band by using a conductive pattern connected to an antenna radiator.

In accordance with an aspect of the present disclosure, an electronic device may include a housing that includes a first plate, a second plate facing away from the first plate, and a side member surrounding a space between the first plate and the second plate, the side member including a first conductive portion, a second conductive portion, a third conductive portion, wherein the first conductive portion is interposed between the second conductive portion and the third conductive portion, a first insulating portion interposed between the first conductive portion and the second conductive portion, and a second insulating portion interposed between the first conductive portion and the third conductive portion, a wireless communication circuitry that is electrically connected to a first point of the first conductive portion, which is adjacent to the second insulating portion, a ground member that is included in the housing, a first switching circuitry that includes a first terminal electrically connected to a second point of the first conductive portion, which is more distant from the second insulating portion than the first point, and at least one second terminal electrically connected to the ground member through at least one first passive element, and a conductive pattern that is electrically connected to the second point and forming a closed loop.

An electronic device according to various embodiments of the present disclosure may expand a frequency variation of a mid-band (1710 MHz to 2170 MHz) by using a closed-loop pattern at a ground region.

The mounting efficiency of the electronic device according to various embodiments of the present disclosure may be improved by disposing the closed-loop pattern on/in a layer different from a printed circuit board.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
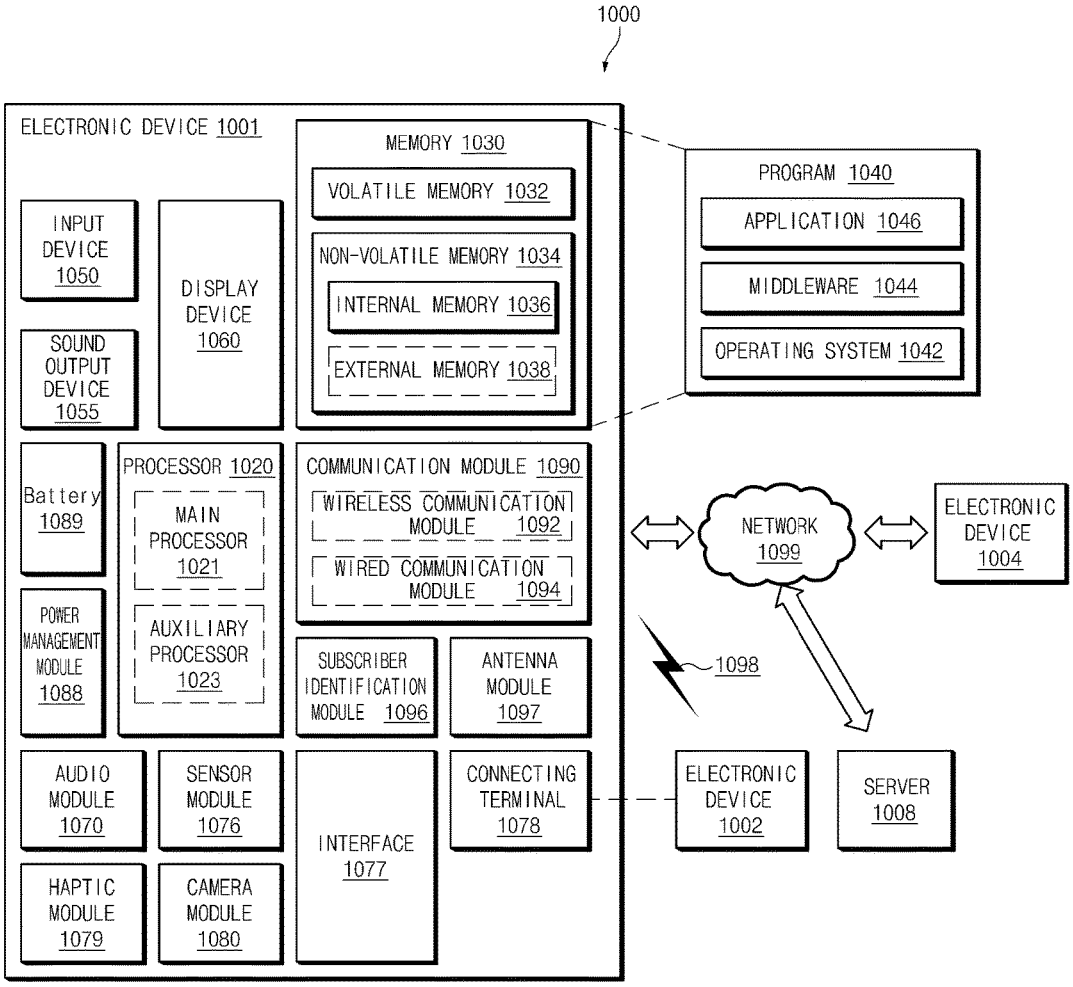
FIG. 1 is a block diagram of an electronic device in a network environment, according to various embodiments.

Below, various embodiments of the present disclosure may be described with reference to accompanying drawings. Accordingly, those of ordinary skill in the art will recognize that modification, equivalent, and/or alternative on the various embodiments described herein can be variously made without departing from the scope and spirit of the present disclosure. With regard to description of drawings, similar components may be marked by similar reference numerals.

In the specification, the expressions "have", "may have", "include" and "comprise", or "may include" and "may comprise" used herein indicate existence of corresponding features (e.g., numeric values, functions, operations, or components such as parts) but do not exclude presence of additional features.

Also, the expressions "A or B", "at least one of A or/and B", or "one or more of A or/and B", and the like used herein may include any and all combinations of one or more of the associated listed items. For example, the term "A or B", "at least one of A and B", or "at least one of A or B" may refer to all of the case (1) where at least one A is included, the case (2) where at least one B is included, or the case (3) where both of at least one A and at least one B are included.

The terms, such as "first", "second", and the like used herein may refer to various components of various embodiments of the present disclosure, but do not limit the elements. For example, "a first user device" and "a second user device" indicate different user devices regardless of the order or priority. For example, without departing the scope of the present disclosure, a first complement may be referred to as a second component, and similarly, a second complement may be referred to as a first complement.

It will be understood that when a complement (e.g., a first complement) is referred to as being "(operatively or communicatively) coupled with/to" or "connected to" another complement (e.g., a second complement), it can be directly coupled with/to or connected to the other complement or an intervening complement (e.g., a third complement) may be present. In contrast, when a complement (e.g., a first complement) is referred to as being "directly coupled with/to" or "directly connected to" another complement (e.g., a second complement), it should be understood that there are no intervening complement (e.g., a third complement).

According to the situation, the expression "configured to" used herein may be used as, for example, the expression "suitable for", "having the capacity to", "designed to", "adapted to", "made to", or "capable of". The term "configured to" must not mean only "specifically designed to" in hardware. Instead, the expression "a device configured to" may mean that the device is "capable of" operating together with another device or other components. For example, a "processor configured to (or set to) perform A, B, and C" may mean a dedicated processor (e.g., an embedded processor) for performing a corresponding operation or a generic-purpose processor (e.g., a central processing unit (CPU) or an application processor) which may perform corresponding operations by executing one or more software programs which are stored in a memory device.

Terms used in the specification are used to describe specified embodiments of the present disclosure and are not intended to limit the scope of the present disclosure. The terms of a singular form may include plural forms unless otherwise specified. All the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal detect unless expressly so defined herein in various embodiments of the present disclosure. In some cases, even though terms are terms which are defined in the specification, they may not be interpreted to exclude embodiments of the present disclosure.

An electronic device according to various embodiments of the present disclosure may include at least one of a smartphone, a tablet personal computer (PC), a mobile phone, a video telephone, an electronic book reader, a desktop PC, a laptop PC, a netbook computer, a workstation, a server, personal digital assistant (PDA), a portable multimedia player (PMP), a Motion Picture Experts Group (MPEG-1 or MPEG-2) Audio Layer 3 (MP3) player, a mobile medical device, a camera, or a wearable device. According to various embodiments, a wearable device may include at least one of an accessory type of device (e.g., a timepiece, a ring, a bracelet, an anklet, a necklace, glasses, a contact lens, or a head-mounted device (HMD)), a one-piece fabric or clothes type of device (e.g., electronic clothes), a body-attached type of device (e.g., a skin pad or a tattoo), or a bio-implantable type of device (e.g., implantable circuit).

Hereinafter, an electronic device according to various embodiments will be described with reference to the accompanying drawings. The term "user" used herein may refer to a person who uses an electronic device or may refer to a device (e.g., an artificial intelligence electronic device) that uses the electronic device.

FIG. 1 is a block diagram of an electronic device 1001 in a network environment 1000, according to various embodiments.

Referring to FIG. 1, the electronic device 1001 in the network environment 1000 may communicate with an electronic device 1002 over a first network 1098 (e.g., a short range wireless communication network) or may communicate with an electronic device 1004 or a server 1008 over a second network 1099 (e.g., a long distance wireless communication network). According to an embodiment, the electronic device 1001 may communicate with the electronic device 1004 through the server 1008. According to an embodiment, the electronic device 1001 may include a processor 1020, a memory 1030, an input device 1050, a sound output device 1055, a display device 1060, an audio module 1070, a sensor module 1076, an interface 1077, a haptic module 1079, a camera module 1080, a power management module 1088, a battery 1089, a communication module 1090, a subscriber identification module 1096, or an antenna module 1097. In any embodiment, at least one (e.g., the display device 1060 or the camera module 1080) of the components may be omitted from the electronic device 1001, or one or more other components may be further included in the electronic device 1001. In any embodiment, some of the components may be implemented with a single integrated circuit. For example, the sensor module 1076 (e.g., a fingerprint sensor, an iris sensor, or an illumination sensor) may be embedded in the display device 1060 (e.g., a display).

The processor 1020 may execute, for example, software (e.g., a program 1040) to control at least one other component (e.g., a hardware or software component) of the electronic device 1001 connected to the processor 1020, and may perform various data processing or operations. According to an embodiment, as at least a part of the data processing or operations, the processor 1020 may load a command or data received from any other component (e.g., the sensor module 1076 or the communication module 1090) to a volatile memory 1032, may process the command or data stored in the volatile memory 1032, and may store processed data in a nonvolatile memory 1034. According to an embodiment, the processor 1020 may include a main processor 1021 (e.g., a central processing unit or an application processor) and a coprocessor 1023 (e.g., a graphic processing device, an image signal processor, a sensor hub processor, or a communication processor), which may be operated independently of or together with the main processor 1021. Additionally or alternatively, the coprocessor 1023 may be configured to use lower power than the main processor 1021 or to be specialized for a specified function. The coprocessor 1023 may be implemented separately from the main processor 1021 or may be implemented as a part of the main processor 1021.

The coprocessor 1023 may control at least a part of a function or states associated with at least one component (e.g., the display device 1060, the sensor module 1076, or the communication module 1090) of the electronic device 1001, for example, instead of the main processor 1021 while the main processor 1021 is in an inactive (e.g., sleep) state and together with the main processor 1021 while the main processor 1021 is in an active (e.g., an application execution) state. According to an embodiment, the coprocessor 1023 (e.g., an image signal processor or a communication processor) may be implemented as a part of any other component (e.g., the camera module 1080 or the communication module 1090) which is functionally (or operatively) associated with the coprocessor 1023.

The memory 1030 may store various data which are used by at least one component (e.g., the processor 1020 or the sensor module 1076) of the electronic device 1001. The data may include, for example, software (e.g., the program 1040), or input data or output data associated with a command of the software. The memory 1030 may include the volatile memory 1032 or the nonvolatile memory 1034.

The program 1040 may be stored in the memory 1030 as software, and may include, for example, an operating system 1042, a middleware 1044, or an application 1046.

The input device 1050 may receive a commands or data which will be used by a component (e.g., the processor 1020) of the electronic device 1001, from the outside (e.g., a user) of the electronic device 1001. The input device 1050 may include, for example, a microphone, a mouse, or a keyboard.

The sound output device 1055 may output a sound signal to the outside of the electronic device 1001. The sound output device 1055 may include, for example, a speaker or a receiver. The speaker may be used for a general purpose such as multimedia play or recording play, and the receiver may be used to receive an incoming call. According to an embodiment, the receiver may be implemented separately from the speaker or may be implemented as a part of the speaker.

The display device 1060 may visually provide information to the outside (e.g., the user) of the electronic device 1001. The display device 1060 may include, for example, a display, a hologram device, or a control circuit for controlling a projector and a corresponding device. According to an embodiment, the display device 1060 may include a touch circuitry configured to sense a touch, or a sensor circuitry (e.g., a pressure sensor) configured to measure the strength of force generated by the touch.

The audio module 1070 may convert sound to an electrical signal, or reversely, may convert an electrical signal to sound. According to an embodiment, the audio module 1070 may obtain sound through the input device 1050, or may output sound through the sound output device 1055, or through an external electronic device (e.g., the electronic device 1002) (e.g., a speaker or a headphone) directly or wirelessly connected with the electronic device 1001.

The sensor module 1076 may sense an operation state (e.g., power or a temperature) of the electronic device 1001 or an external environment state (e.g., a user state), and may generate an electrical signal or a data value corresponding the sensed state. According to an embodiment, the sensor module 1076 may include, for example, a gesture sensor, a grip sensor, a barometric pressure sensor, a magnetic sensor, an acceleration sensor, a grip sensor, a proximity sensor, a color sensor, an infrared (IR) sensor, a biometric sensor, a temperature sensor, a humidity sensor, or an illumination sensor.

The interface 1077 may support one or more specified protocols that may be used to directly and wirelessly connect the electronic device 1001 with an external electronic device (e.g., the electronic device 1002). According to an embodiment, the interface 1077 may include, for example, a high definition multimedia interface (HDMI), a universal serial bus (USB) interface, a secure digital (SD) card interface, or an audio interface.

A connection terminal 1078 may include a connector that may allow the electronic device 1001 to be physically connected with an external electronic device (e.g., the electronic device 1002). According to an embodiment, the connection terminal 1078 may include, for example, a HDMI connector, a USB connector, a SD card connector, or an audio connector (e.g., a headphone connector).

The haptic module 1079 may convert an electrical signal to a mechanical stimulation (e.g., vibration or movement) or an electrical stimulation which the user may perceive through the sense of touch or the sense of movement. According to an embodiment, the haptic module 1079 may include, for example, a motor, a piezoelectric sensor, or an electrical stimulation device.

The camera module 1080 may photograph a still image and a video. According to an embodiment, the camera module 1080 may include one or more lenses, image sensors, image signal processors, or flashes (or electrical flashes).

The power management module 1088 may manage the power which is supplied to the electronic device 1001. According to an embodiment, the power management module 1088 may be implemented, for example, as at least a part of a power management integrated circuit (PMIC).

The battery 1089 may power at least one component of the electronic device 1001. According to an embodiment, the battery 1089 may include, for example, a primary cell not recharged, a secondary cell rechargeable, or a fuel cell.

The communication module 1090 may establish a direct (or wired) communication channel or a wireless communication channel between the electronic device 1001 and an external electronic device (e.g., the electronic device 1002, the electronic device 1004, or the server 1008) or may perform communication through the established communication channel. The communication module 1090 may include one or more communication processors which is operated independently of the processor 1020 (e.g., an application processor) and supports direct (or wired) communication or wireless communication. According to an embodiment, the communication module 1090 may include a wireless communication module 1092 (e.g., a cellular communication module, a short range wireless communication module, or a global navigation satellite system (GNSS) communication module) or a wired communication module 1094 (e.g., a local area network (LAN) communication module or a power line communication module). A corresponding communication module of such communication modules may communicate with an external electronic device over the first network 1098 (e.g., a short range communication network such as Bluetooth, Wi-Fi direct, or infrared data association (IrDA)) or the second network 1099 (e.g., a long distance communication network such as a cellular network, an Internet, or a computer network (e.g., LAN or WAN)). The above-described kinds of communication modules may be integrated in one component (e.g., a single chip) or may be implemented with a plurality of components (e.g., a plurality of chips) which are independent of each other. The wireless communication module 1092 may verify and authenticate the electronic device 1001 within a communication network, such as the first network 1098 or the second network 1099, by using subscriber information (e.g., international mobile subscriber identity (IMSI)) stored in the subscriber identification module 1096.

The wireless communication module 1092 according to various embodiments of the present disclosure may expand a frequency variation of a mid-band (1710 MHz to 2170 MHz) by using a closed-loop pattern at a ground region.

The antenna module 1097 may transmit a signal or a power to the outside (e.g., an external electronic device) or may receive a signal or a power from the outside. According to an embodiment, the antenna module 1097 may include one or more antennas, and at least one antenna which is suitable for a communication scheme used in a computer network such as the first network 1098 or the second network 1099 may be selected, for example, by the communication module 1090 from the one or more antennas. The signal or power may be exchanged between the communication module 1090 and an external electronic device through the selected at least one antenna or may be received from the external electronic device through the selected at least one antenna and the communication module 1090.

At least some of the components may be connected to each other through a communication scheme (e.g., a bus, a general purpose input and output (GPIO), a serial peripheral interface (SPI), or a mobile industry processor interface (MIPI)) between peripheral devices and may exchange signals (e.g., commands or data) with each other.

According to an embodiment, a command or data may be transmitted or received (or exchanged) between the electronic device 1001 and the external electronic device 1004 through the server 1008 connecting to the second network 1099. Each of the electronic devices 1002 and 1004 may be a device, the kind of which is the same as or different from a kind of the electronic device 1001. According to an embodiment, all or a part of operations to be executed in the electronic device 1001 may be executed in one or more external devices of the external electronic devices 1002, 1004, or 1008. For example, in the case where the electronic device 1001 should perform any function or service automatically or in response to a request from the user or any other device, the electronic device 1001 may request one or more external electronic devices to perform at least a part of the function or service, instead of internally executing the function or service or additionally. The one or more external electronic devices which receive the request may execute at least a part of the function or service thus requested or an additional function or service associated with the request, and may provide a result of the execution to the electronic device 1001. The electronic device 1001 may process received result as it is or additionally, and may provide a result of the processing as at least a part of the response to the request. To this end, for example, a cloud computing, distributed computing, or client-server computing technology may be used.

Figure 2A:
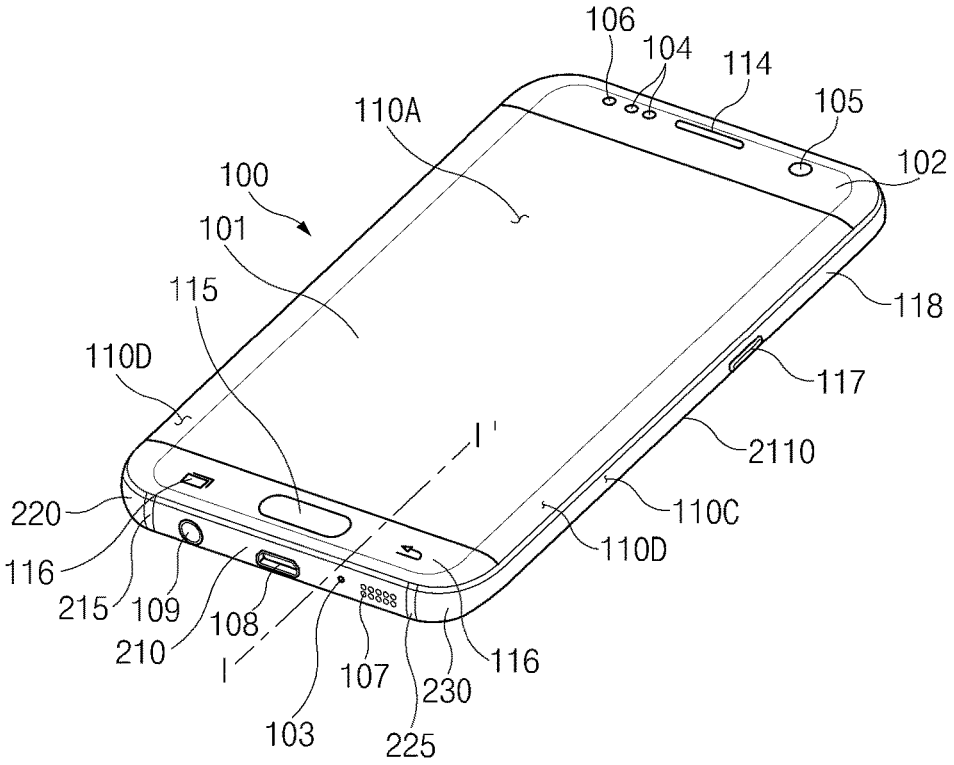
FIG. 2A is a perspective view of a mobile electronic device according to an embodiment.
Figure 2B:
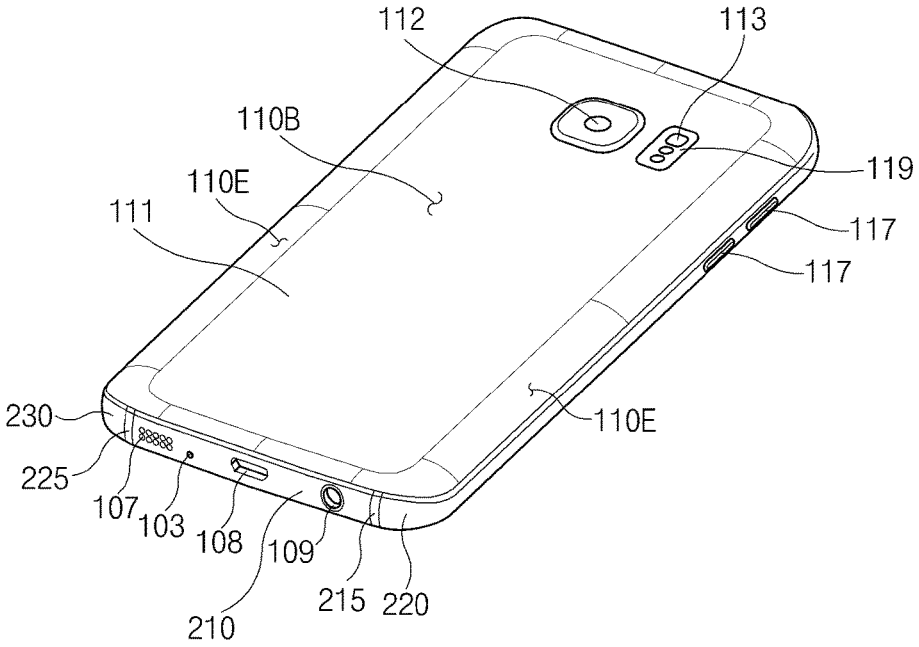
FIG. 2B is a perspective view of a rear surface of an electronic device of FIG. 1.

Referring to FIGS. 2A and 2B, an electronic device 100 (e.g., the electronic device 1001 of FIG. 1) according to an embodiment may include a housing 110 which includes a first surface (or a front surface) 110A, a second surface (or a rear surface) 110B, and a side surface 110C surrounding a space between the first surface 110A and the second surface 110B. In another embodiment (not illustrated), a housing may refer to a structure which forms a part of the first surface 110A, the second surface 110B, and side surfaces 110C of FIG. 2A. According to an embodiment, the first surface 110A may be formed by a front plate (e.g., a first plate) 102 (e.g., a glass plate including various coating layers, or a polymer plate), at least a part of which is substantially transparent. The second surface 110B may be formed by a rear plate (or a second plate) 111 which is substantially opaque. The rear plate 111 may be formed by coated or colored glass, ceramic, polymer, metal (e.g., aluminum, stainless steel (STS), or magnesium), or a combination of at least two of the materials. The side surface 111C may be coupled with the front plate 102 or the rear plate 111, and may be formed by a side bezel structure (or "a side member") 118 including metal and/or polymer. In any embodiment, the rear plate 111 and the side bezel structure 118 may be integrally formed and may include the same material (e.g., a metal material such as aluminum).

In the illustrated embodiment, the front plate 102 may include a first region 110D, which is bent toward the rear plate 111 from the first surface 110A so as to be seamlessly extended, in each of opposite long edges of the front plate 102. In the illustrated embodiment (refer to FIG. 2B), the rear plate 111 may include a second region 110E, which is bent toward the front plate 102 from the second surface 110B so as to be seamlessly extended, in each of the opposite long edges. In any embodiment, the front plate 102 or the rear plate 111 may include only one of the first region 110D or the second region 110E. In the embodiments, when viewed from a side surface of the electronic device 100, a side bezel structure may have a first thickness (or width) at a side surface where the first region 110D or the second region 110E is not included, and may has a second thickness smaller than the first thickness at a side surface including the first region 110D or the second region 110E.

According to an embodiment, the electronic device 100 may include at least one or more of a display 101 (e.g., the display device 1060 of FIG. 1), an audio module 103, 107, and 114 (e.g., the audio module 1070 of FIG. 1), a sensor module 104 and 119 (e.g., the sensor module 1076 of FIG. 1), a camera module 105, 112, and 113 (e.g., the camera module 1080 of FIG. 1), a key input device 115, 116, and 117, an indicator 106, and a connector hole 108 and 109. In any embodiment, the electronic device 100 may not include at least one (e.g., the key input device 115, 116, and 117 or the indicator 106) of the components or may further include any other component.

The display 101 may be exposed through a considerable portion of the front plate 102, for example. In any embodiment, at least a part of the display 101 may be exposed through the first surface 110A and the front plate 102 forming the first region 110D of the side surface 110C. The display 101 may be coupled with a touch sensing circuitry, a pressure sensor which may measure the intensity (or pressure) of a touch, and/or a digitizer detecting a magnetic stylus pen or may be disposed adjacent thereto. In any embodiment, at least a part of the sensor module 104 and 119 and/or at least a part of the key input device 115, 116, and 117 may be disposed in the first region 110D and/or the second region 110E.

The audio module 103, 107, and 114 may include a microphone hole 103 and a speaker hole 107 and 114. A microphone for obtaining external sound may be disposed inside the microphone hole 103; in any embodiment, a plurality of microphones may be disposed inside the microphone hole 103. The speaker hole 107 and 114 may include an external speaker hole 107 and a receiver hole 114 for call. In any embodiment, the speaker hole 107 and 114 and the microphone hole 103 may be implemented with one hole, or a speaker (e.g., a piezo speaker) may be included without the speaker hole 107 and 114.

The sensor module 104 and 119 may generate an electrical signal or a data value corresponding to an internal operation state of the electronic device 100 or corresponding to an external environment state. The sensor module 104 and 119 may include, for example, a first sensor module 104 (e.g., a proximity sensor) and/or a second sensor module (not illustrated) (e.g., a fingerprint sensor) disposed on the first surface 110A of the housing 110, and/or a third sensor module 119 (e.g., a hear rate monitor (HRM) sensor) disposed on the second surface 110B of the housing 110. The fingerprint sensor may be disposed on the second surface 110B as well as the first surface 110A (e.g., a home key button 115) of the housing 110. The electronic device 100 may include a sensor module not illustrated, for example, at least one of a gesture sensor, a grip sensor, a barometric pressure sensor, a magnetic sensor, an acceleration sensor, a grip sensor, a color sensor, an IR sensor, a biometric sensor, a temperature sensor, a humidity sensor, or an illumination sensor.

The camera module 105, 112, and 113 may include a first camera device 105 disposed on the first surface 110A of the electronic device 100, and a second camera module 112, and/or a flash 113 disposed on the second surface 110B. The camera modules 105 and 112 may include one or plural lenses, an image sensor, and/or an image signal processor. The flash 113 may include, for example, a light emitting diode or a xenon lamp. In any embodiment, two or more lenses (wide-angle and telephoto lens) and image sensors may be disposed on one surface of the electronic device 100.

The key input device 115, 116, and 117 may include the home key button 115 disposed on the first surface 110A of the housing 110, a touch pad 116 disposed in the vicinity of the home key button 115, and/or a side key button 117 disposed on the side surface 110C of the housing 110. In another embodiment, the electronic device 100 may not include all or a part of the aforementioned key input devices 115, 116, and 117, and the key input device not included may be implemented in the form of a soft key on the display 101.

The indicator 106 may be disposed, for example, on the first surface 110A of the housing 110. The indicator 106 may provide state information of the electronic device 100, for example, in the form of light, and may include an LED.

The connector hole (108, 109) may include a first connector hole 108 which may accommodate a connector (e.g., a USB connector) for transmitting/receiving a power and/or data to/from an external electronic device, and/or a second connector hole (or an earphone j ack) 109 which may accommodate for transmitting/receiving an audio signal to/from the external electronic device.

According to various embodiments, the side bezel structure 118 may include a first conductive member (or a first conductive portion) 210, a second conductive member (or a second conductive portion) 220, a third conductive member (or a third conductive portion) 230, a first nonconductive member (or a first insulating portion) 215, and a second nonconductive member (or a second insulating portion) 225. The first nonconductive member 215 may be interposed between the first conductive member 210 and the second conductive member 220. The second nonconductive member 225 may be interposed between the first conductive member 210 and the third conductive member 230. The first conductive member 210 is exemplified in FIGS. 2A and 2B as being disposed at a lower end of a side surface of the electronic device 100, but the present disclosure is not limited thereto.

According to various embodiments, at least one of the first conductive member 210, the second conductive member 220, or the third conductive member 230 may be utilized as a radiator for wireless communication. Below, a description will be focused on the case where the first conductive member 210 is utilized as an antenna radiator, but the present disclosure is not limited thereto.

According to various embodiments, the first conductive member 210 may include a feeding point and a ground point. The feeding point may be a point which is supplied with a power from a board (or substrate) in the electronic device 100. The ground point may be a point which is connected to a ground in the electronic device 100.

According to various embodiments, the first conductive member 210 may be connected to a closed-loop pattern (not illustrated) at the ground point. The closed-loop pattern may operate as one electrical path in an antenna. In certain embodiments, the closed loop pattern operating as one electrical path in an antenna may transmit and receive signals having a frequency between 1700 MHz to 2200 MHz.

Figure 3:
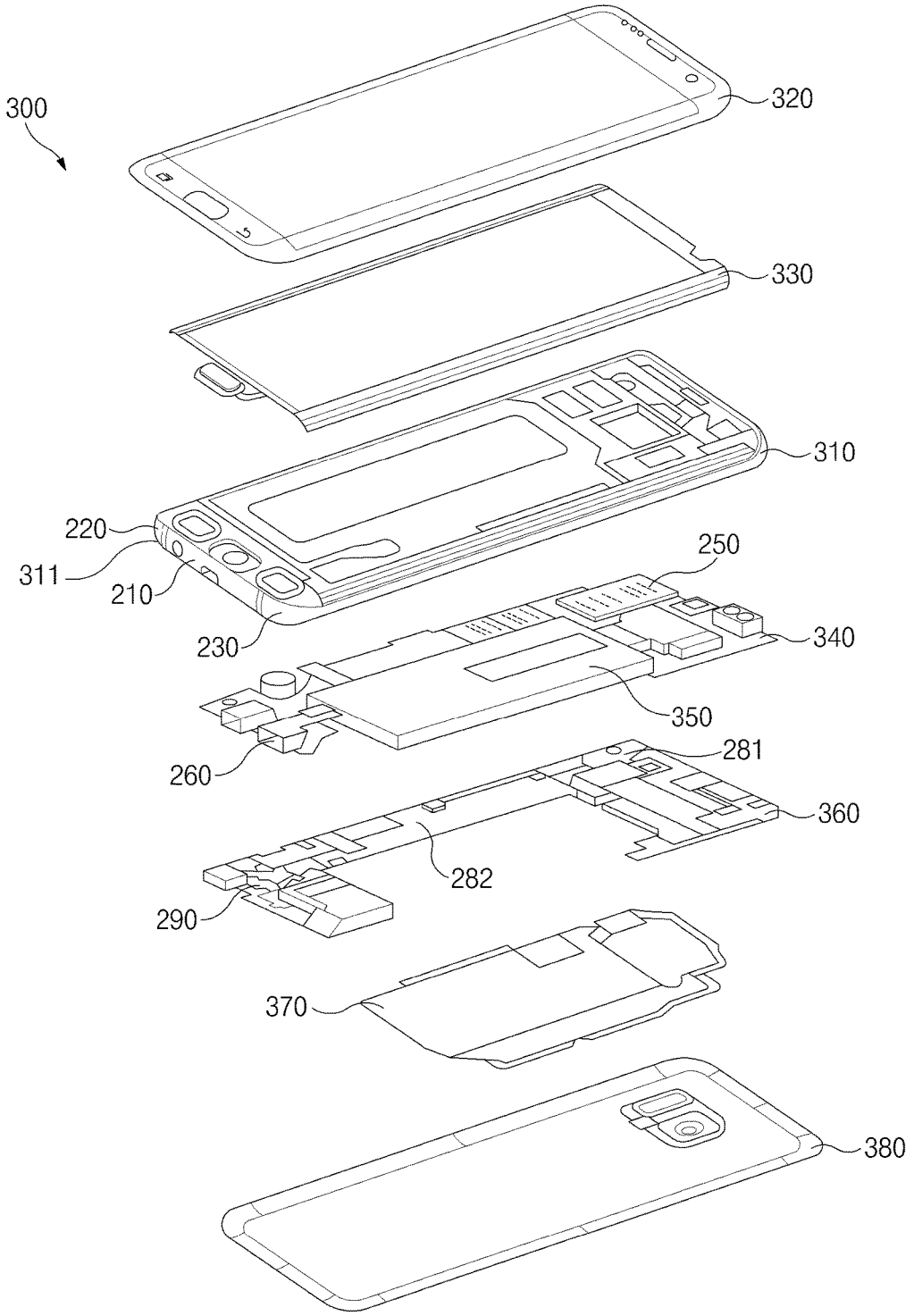
FIG. 3 is an exploded perspective view of an electronic device of FIG. 1.

Referring to FIG. 3, an electronic device 300 may include a side bezel structure 310 (e.g., including the side bezel structure 118 and the first to third conductive members 210 to 230 of FIGS. 2A and 2B), a first support member 311 (e.g., a bracket), a front plate 320, a display 330, a printed circuit board 340 (e.g., including a first board (e.g., a main board) 250 and a second board (e.g., a sub printed board assembly (PBA)) 260, a battery 350, a second support member 360 (e.g., a rear case) (e.g., including first, second, and third sub support members 281, 282, and 290), an antenna 370, and a rear plate 380. In any embodiment, the electronic device 300 may not include at least one (e.g., the first support member 311 or the second support member 360) of the components or may further include any other component. At least one of the components of the electronic device 300 may be similar to or the same as at least one of the components of the electronic device 100 of FIG. 2A or 2B. Thus, additional description will be omitted to avoid redundancy.

The first support member 311 may disposed inside the electronic device 300, and may be connected with the side bezel structure 310 or may be integrally formed with the side bezel structure 310. The first support member 311 may be formed of, for example, a metal material and/or a nonmetal material (e.g., polymer). The display 330 may be coupled with one surface of the first support member 311, and the printed circuit board 340 may be coupled with an opposite surface of the first support member 311. A processor, a memory, and/or an interface may be mounted on the printed circuit board 340. For example, the processor (e.g., the processor 1020 of FIG. 1) may include one or more of a central processing unit, an application processor, a graphic processor device, an image signal processor, a sensor hub processor, or a communication processor.

The memory (e.g., the memory 1030 of FIG. 1) may include a volatile memory and/or a nonvolatile memory, for example. For example, the memory may store data used for an operation of the electronic device 300. A communication circuitry may perform an operation for wireless communication with an external device.

The interface (e.g., the interface 1077) may include, for example, an HDMI, a USB interface, an SD card interface, or an audio interface. The interface may electrically or physically connect, for example, the electronic device 300 with an external electronic device and may include a USB connector, an SD card/MMC connector, or an audio connector.

The first, second, and third sub support members 281, 282, and 290 may protect the first board (e.g., a main board) 250 and the second board (e.g., a sub PBA) 260, and may fix components on a rear surface of the electronic device 300.

The first, second, and third sub support members 281, 282, and 290 may be used to mount various components. For example, the first, second, and third sub support members 281, 282, and 290 may be used to mount a speaker, an antenna array, and the like.

According to various embodiments, the third sub support member (e.g., an antenna carrier) 290 may include a closed-loop pattern (not illustrated). The closed-loop pattern (not illustrated) may be connected to the ground point of the first conductive member 210. The closed-loop pattern may be utilized as one electrical path in an antenna.

The battery 350 (e.g., the battery 1089 of FIG. 1) that is a device for supplying a power to at least one component of the electronic device 300 may include, for example, a primary cell not recharged, a secondary cell rechargeable, or a fuel cell. At least a part of the battery 350 may be disposed on substantially the same plane as the printed circuit board 340, for example. The battery 350 may be integrally disposed inside the electronic device 300, and may be disposed removable from the electronic device 300.

The antenna 370 (e.g., the antenna module 1097 of FIG. 1) may be interposed between the rear plate 380 and the battery 350. The antenna 370 may include, for example, a near field communication (NFC) antenna, an antenna for wireless charging, and/or a magnetic secure transmission (MST) antenna. For example, the antenna 370 may perform short range communication with an external device or may wirelessly transmit/receive a power needed for charging. In another embodiment, an antenna structure may be formed by a part of the side bezel structure 310 and/or the first support member 311, or by a combination thereof.

Figure 4:
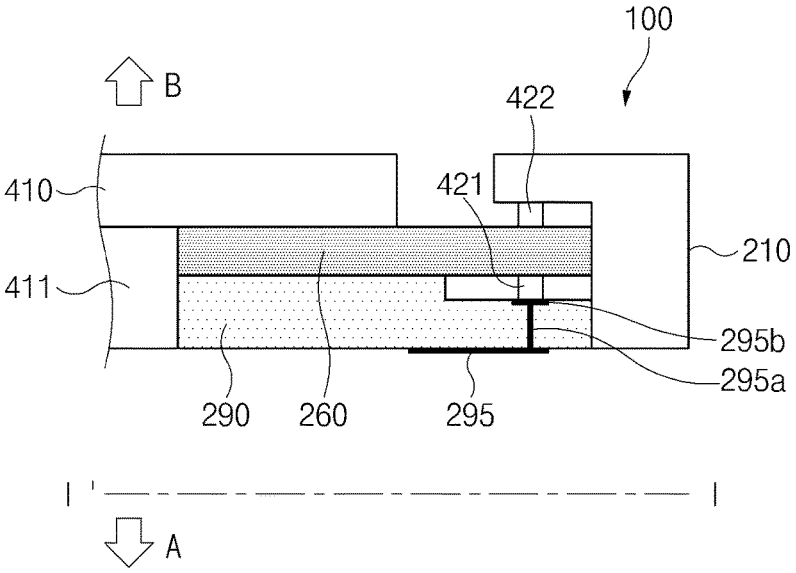
FIG. 4 is a sectional view of an electronic device according to various embodiments.

FIG. 4 is a sectional view of an electronic device according to various embodiments. FIG. 4 is a sectional view of the electronic device 100 taken along a line I-I' of FIG. 2.

Referring to FIG. 4, an electronic device (e.g., the electronic device 1001 of FIG. 1, the electronic device 100 of FIGS. 2A and 2B, or the electronic device 300 of FIG. 3) may include an antenna for wireless communication, which is composed of a first conductive member 210, a third sub support member 290, a second board 260, a first connection member (e.g., a c-clip, a connector, or a pogo pin) 421, and a second connection member (e.g., a c-clip, a connector, or a pogo pin) 422. A fourth sub support member 410 (e.g., a bracket) and a peripheral structure 411 may be disposed in the vicinity of the third sub support member 290 and the second board 260.

According to various embodiments, a closed-loop pattern 295 may be mounted on the third sub support member 290. At least a part of the closed-loop pattern 295 may be formed on a first surface (e.g., a surface facing a rear plate or a surface facing in direction "A") of the third sub support member 290. For example, the closed-loop pattern 295 may be implemented in a laser direct structuring (LDS) scheme. The closed-loop pattern 295 may be connected to the ground point of the first conductive member 210. The first conductive member 210 may operate as a radiator of an antenna. In certain embodiments, the closed-loop pattern is formed substantially, or within 3 degrees of parallel with an active region of the display 101.

According to various embodiments, the closed-loop pattern 295 may extend toward a second surface (e.g., a surface facing a display or a surface facing in direction "B") of the third sub support member 290. For example, a first portion 295*a* of the closed-loop pattern 295 may penetrate the third sub support member 290. A second portion 295*b* of the closed-loop pattern 295 may form a contact part on the second surface (e.g., a surface facing in direction "B") of the third sub support member 290.

According to various embodiments, the first connection member (e.g., a c-clip) 421 may electrically connect the second portion 295*b* of the closed-loop pattern 295 and the second board (e.g., a sub PBA) 260. The first connection member (e.g., a c-clip) 421 may be electrically connected with the first surface (e.g., a surface facing a rear plate or a surface facing in direction "A") of the second board (e.g., a sub PBA) 260.

According to various embodiments, the second connection member (e.g., a c-clip) 422 may electrically connect the first conductive member 210 and the second board (e.g., a sub PBA) 260. For example, the second connection member (e.g., a c-clip) 422 may be electrically connected with the second surface (e.g., a surface facing a display or a surface facing in direction "B") of the second board (e.g., a sub PBA) 260.

According to various embodiments, the first connection member (e.g., a c-clip) 421 and the second connection member (e.g., a c-clip) 422 may be electrically connected to each other. For example, the first connection member (e.g., a c-clip) 421 and the second connection member (e.g., a c-clip) 422 may make contact with the same contact point on the second board (e.g., a sub PBA) 260.

According to various embodiments, in the second board 260, the contact point where the first connection member (e.g., a c-clip) 421 and the second connection member (e.g., a c-clip) 422 make contact with each other may be connected to a ground through a switching circuitry and a matching circuitry.

Figure 5:
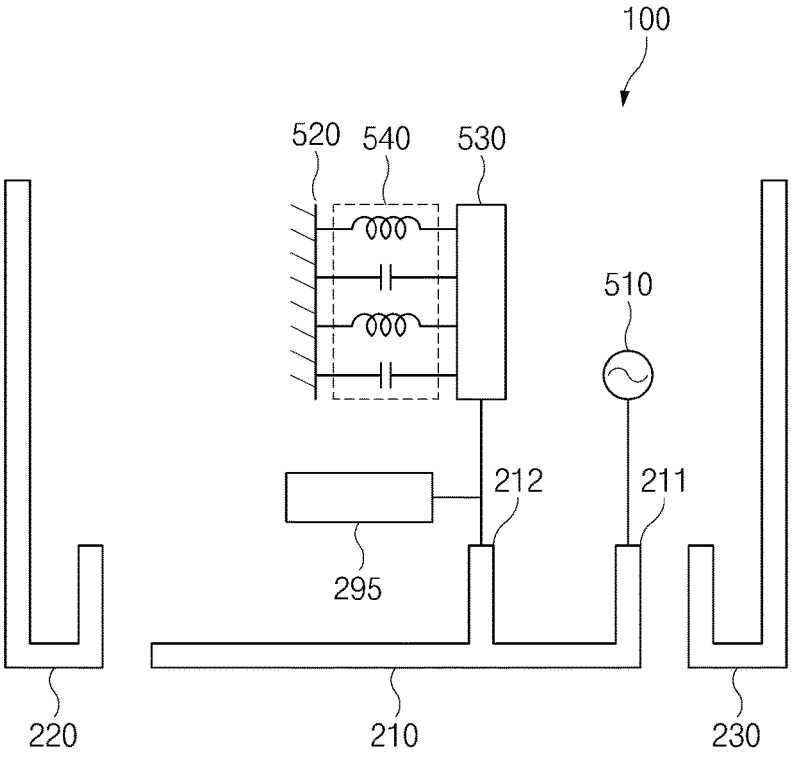
FIG. 5 is a circuit diagram of an antenna including a closed-loop pattern according to various embodiments.

FIG. 5 is a circuit diagram of an antenna including a closed-loop pattern according to various embodiments. The first conductive pattern 210 is exemplified in FIG. 5 as being implemented in an inverted F type, but the present disclosure is not limited thereto.

Referring to FIG. 5, the first conductive member 210 may include a feeding point 211 and a ground point 212. The first conductive member 210 may be connected to a feeding part (or a power supply part of a wireless communication circuit) 510 at the feeding point 211. The first conductive member 210 may be supplied with a power from the feeding part 510. The first conductive member 210 may be connected with the closed-loop pattern 295 and a ground switching circuitry 530 at the ground point 212.

According to various embodiments, the closed-loop pattern 295 may provide an electrical path. For example, the closed-loop pattern 295 may be implemented in a laser direct structuring (LDS) scheme.

According to various embodiments, the first conductive member 210 may be connected to a ground part (or a ground member included in a housing) 520 through the ground switching circuitry 530 and a matching circuitry 540.

According to various embodiments, the ground switching circuitry (or a first switching circuitry) 530 may connect the matching circuitry 540 and the ground point 212 of the first conductive member 210. The ground switching circuitry 530 may include a switch which operates under control of a processor (e.g., an application processor (AP) or a communication processor (CP)) in the electronic device 100. The ground switching circuitry 530 may connect at least one of a plurality of matching elements (e.g., an inductor or a capacitor) included in the matching circuitry 540 to the ground point 212. A first terminal of the ground switching circuitry 530 may be electrically connected to the ground point 212. At least one second terminal of the ground switching circuitry 530 may be electrically connected to the ground part 520 through a passive element (or a lumped element) included in the matching circuitry 540. In various embodiments, the passive element may include at least one of an inductor, a capacitor, or a resistor.

According to various embodiments, the matching circuitry 540 may include a plurality of matching elements (e.g., an inductor or a capacitor) connected in parallel between the ground switching circuitry 530 and the ground part 520. A first end of each of the plurality of matching elements may be connected to the ground part 520, and a second end thereof may be connected to the ground switching circuitry 530. According to an embodiment, at least one of the plurality of matching elements may be connected to the ground point 212 of the first conductive member 210 by a switching operation of the ground switching circuitry 530. According to another embodiment, all of the plurality of matching elements may not be connected to the ground point 212 of the first conductive member 210 by a switching operation of the ground switching circuitry 530. According to certain embodiments, the feeding part 510 and ground part 520 can be disposed or included on a board, such as first board 250, and second board 260.

Figure 6:
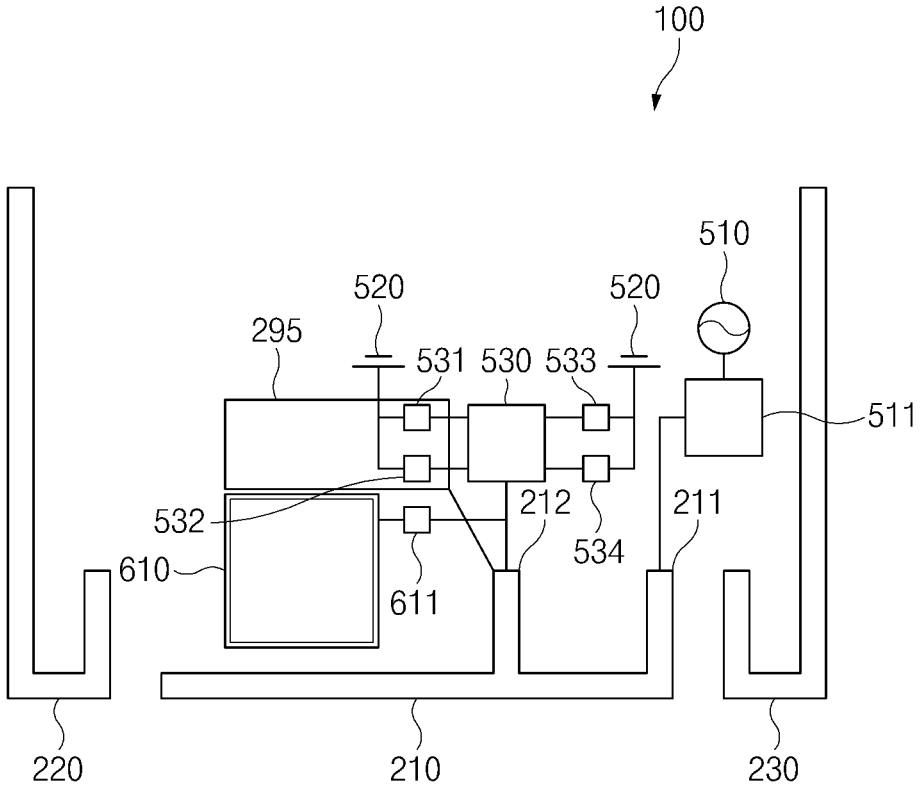
FIG. 6 illustrates how an antenna is placed in an electronic device, according to various embodiments.

FIG. 6 illustrates how an antenna is placed in an electronic device, according to various embodiments. FIG. 6 is, but is not limited to, an example.

Referring to FIG. 6, the first conductive member 210 may include the feeding point 211 and the ground point 212. The first conductive member 210 may be connected to the feeding part 510 at the feeding point 211. According to an embodiment, the first conductive member 210 may be connected to the feeding part 510 through a feeding switching circuitry 511. The feeding switching circuitry 511 may include a switch and ground switching circuitry may include a switch which operate under control of a processor (e.g., AP) or a communication circuitry (e.g., CP) in the electronic device 100. The feeding switching circuitry 511 and the ground switching circuitry 530 may change a frequency band where the first conductive member 210 resonates, by a switching operation. A first terminal of the feeding switching circuitry 511 may be electrically connected to the feeding part 510. A second terminal of the feeding switching circuitry 511 may be electrically connected to the feeding point 211 through at least one passive element and/or at least one active element. In an embodiment, the passive element may include at least one of an inductor, a capacitor, or a resistor. The active element may include at least one of a transistor or a diode.

According to various embodiments, the first conductive member 210 may be connected with the closed-loop pattern 295 and the ground switching circuitry 530 at the ground point 212. The closed-loop pattern 295 may provide an electrical path.

According to an embodiment, the closed-loop pattern 295 may be formed at the ground switching circuitry 530, or a component different from the matching circuitry 540. For example, as illustrated in FIG. 4, the closed-loop pattern 295 may be formed at the third sub support member 290. The ground switching circuitry 530 or the matching circuitry 540 may be formed on the second board (e.g., a sub PBA) 260.

According to various embodiments, the first conductive member 210 may be connected to the ground part 520 through the ground switching circuitry 530 and the matching circuitry 540. The ground switching circuitry 530 may be implemented, for example, in the form of one chip. The ground switching circuitry 530 may include a switch which operates under control of a processor (e.g., AP) or a communication circuitry (e.g., CP) in the electronic device 100. The ground switching circuitry 530 may connect at least one of a plurality of matching elements 531 to 534 to the ground point 212 of the first conductive member 210.

According to various embodiments, a first end of each of the plurality of matching elements 531 to 534 may be connected to the ground part 520, and a second end thereof may be connected to the ground switching circuitry 530. According to an embodiment, at least one of the plurality of matching elements 531 to 534 may be connected to the ground point 212 of the first conductive member 210 by a switching operation of the ground switching circuitry 530.

According to various embodiments, the electronic device 100 may further include a connector 610 and an additional matching element 611. For example, the connector 610 may be used for data communication with an external device or for a power supply. For another example, a first end of the additional matching element 611 may be connected to the ground point 212 of the first conductive member 210. A second end of the additional matching element 611 may be connected to the connector 610. The connector 610 and the additional matching element 611 may provide a separate electrical path in a wireless communication process.

Figure 7:
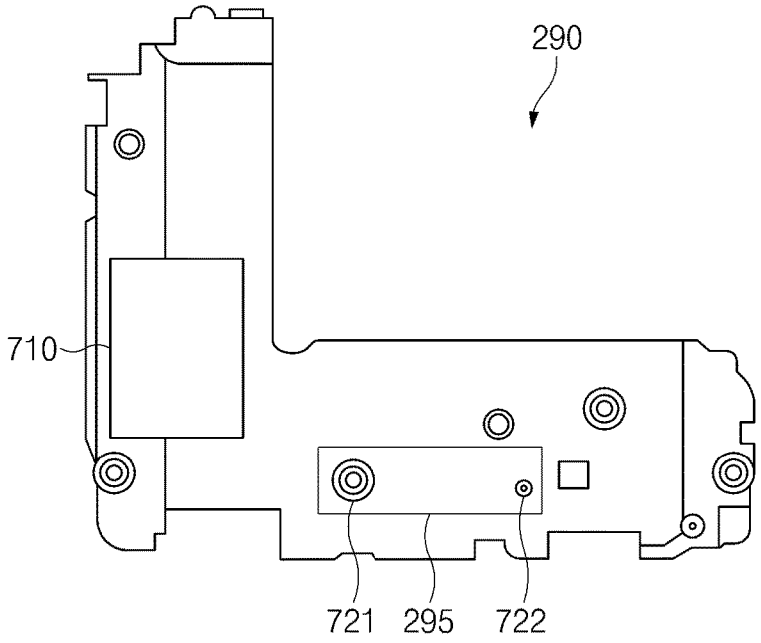
FIG. 7 illustrates an implementation shape of a third sub support member according to various embodiments.

FIG. 7 illustrates an implementation shape of a third sub support member according to various embodiments. FIG. 7 is, but is not limited to, an example.

Referring to FIG. 7, the closed-loop pattern 295 may be mounted on the third sub support member 290. In an embodiment, the closed-loop pattern 295 may be disposed adjacent to the first conductive member 210 which is disposed at a lower end of the electronic device 100.

According to an embodiment, the third sub support member 290 may include fixing parts 721 and 722 for a connection with another component (e.g., the second board 260). The closed-loop pattern 295 may be formed, for example, not to overlap a point where the fixing parts 721 and 722 are placed.

According to an embodiment, various parts may be mounted on the third sub support member 290. For example, a sound output module 710 may be mounted on the third sub support member 290. The sound output module (or a speaker module) (e.g., the sound output device 1055 of FIG. 1) 710 may include, for example, an internal speaker and an encloser surrounding the speaker. According to an embodiment, unlike illustration of FIG. 7, the sound output module 710 may be mounted adjacent to the first conductive member 210. In this case, when viewed from above a rear plate (e.g., the rear plate 111) of the electronic device 100, the closed-loop pattern 295 may overlap at least a part of the sound output module 710.

Figure 8:
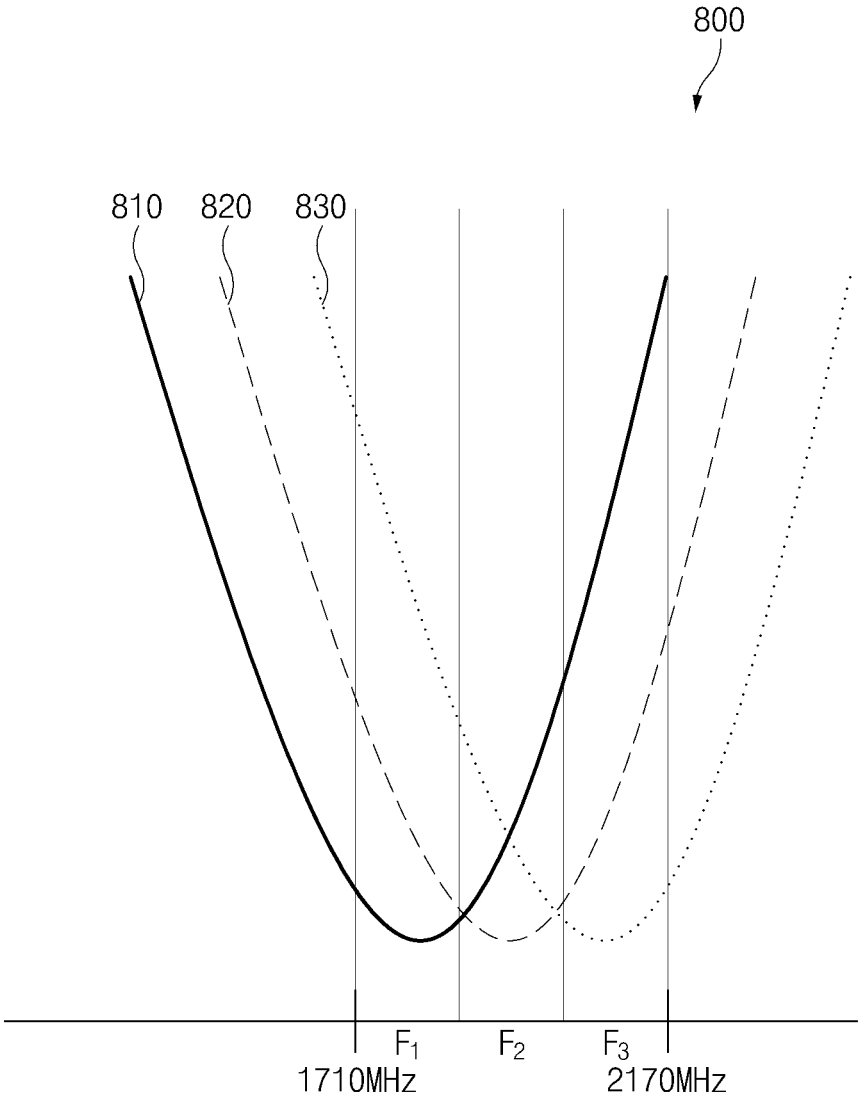
FIG. 8 is a graph illustrating a change of a frequency band through a switching operation, according to various embodiments.

FIG. 8 is a graph 800 illustrating a change of a frequency band through a switching operation, according to various embodiments. FIG. 8 is, but is not limited to, an example.

Referring to FIG. 8, a processor (e.g., an AP) or a communication circuitry (e.g., a CP) of the electronic device 100 may switch the feeding switching circuitry 511 or the ground switching circuitry 530 of FIG. 6 to change a frequency band, in which an antenna resonates, through the first conductive member 210 and the closed-loop pattern 295.

For example, in a graph 810, in the case where a second switch of first to third switches included in the feeding switching circuitry 511 is in a turn-on state and the first switch and third switch are in a turn-off state and in the case where a first matching element RF1 is connected to the first conductive member 210 through the ground switching circuitry 530, the first conductive member 210 may transmit and receive a signal in a first frequency band $F_1$.

For another example, in a graph 820, in the case where all the first to third switches included in the feeding switching circuitry 511 is in a turn-on state and in the case where a second matching element RF2 is connected to the first conductive member 210 through the ground switching circuitry 530, the first conductive member 210 may transmit and receive a signal in a second frequency band $F_2$.

For another example, in a graph 830, in the case where all the first to third switches included in the feeding switching circuitry 511 is in a turn-on state and in the case where the ground switching circuitry 530 is in an isolation state, the first conductive member 210 may transmit and receive a signal in a third frequency band $F_3$.

An electronic device (e.g., the electronic device 100 of FIGS. 2A and 2B) according to various embodiments may include a housing (e.g., the housing 110 of FIGS. 2A and 2B) that includes a first plate (e.g., the front plate 102 of FIGS. 2A and 2B), a second plate (e.g., the rear plate 111 of FIGS. 2A and 2B) facing away from the first plate, and a side member (e.g., the side bezel structure 118 of FIGS. 2A and 2B) surrounding a space between the first plate and the second plate, wherein the side member includes a first conductive portion (e.g., the first conductive member 210 of FIGS. 2A and 2B), a second conductive portion (e.g., the second conductive member 220 of FIGS. 2A and 2B), a third conductive portion (e.g., the third conductive member of FIGS. 2A and 2B), wherein the first conductive portion is interposed between the second conductive portion and the third conductive portion, a first insulating portion (e.g., the first nonconductive member 215 of FIGS. 2A and 2B) interposed between the first conductive portion and the second conductive portion, and a second insulating portion (e.g., the second nonconductive member 225 of FIGS. 2A and 2B) interposed between the first conductive portion and the third conductive portion, a wireless communication circuitry (the communication module 1090 of FIG. 1) that is electrically connected to a first point of the first conductive portion, which is adjacent to the second insulating portion, a ground member (e.g., the ground part 520 of FIG. 5) that is included in the housing, a first switching circuitry (e.g., the ground switching circuitry 530 of FIG. 5) that includes a first terminal electrically connected to a second point of the first conductive portion, which is more distant from the second insulating portion than the first point, and at least one second terminal electrically connected to the ground member through at least one first passive element, and a conductive pattern (e.g., the closed-loop pattern 295 of FIG. 5) that is electrically connected to the second point and forming a closed loop.

According to various embodiments, the wireless communication circuitry may transmit and receive a signal having a frequency between 1700 MHz to 2200 MHz.

According to various embodiments, the first passive element (e.g., the matching circuitry 540 of FIG. 5) may include at least one of an inductor, a capacitor, or a resistor.

According to various embodiments, the electronic device (e.g., the electronic device 100 of FIGS. 2A and 2B) may further include a speaker module (e.g., the sound output module 710 of FIG. 7) that is mounted adjacent to the first conductive portion inside the housing. When viewed from above the second plate, the conductive pattern may overlap at least a part of the speaker module.

According to various embodiments, the electronic device (e.g., the electronic device 100 of FIGS. 2A and 2B) may further include a second switching circuitry (e.g., the feeding switching circuitry 511 of FIG. 6) that includes a third terminal electrically connected to the wireless communication circuitry, and at least one fourth terminal electrically connected to the first point through at least one second passive element and/or at least one active element. The second passive element may include at least one of an inductor, a capacitor, or a resistor. The active element may include at least one of a transistor or a diode.

An electronic device (e.g., the electronic device 100 of FIGS. 2A and 2B) according to various embodiments may include a housing (e.g., the housing 110 of FIGS. 2A and 2B), a first conductive member (e.g., the first conductive member 210 of FIGS. 2A and 2B) that is formed on a side of the housing, a closed-loop pattern (e.g., the closed-loop pattern 295 of FIG. 5) that is disposed inside the housing, a board (e.g., the first board 250 of FIG. 3) that includes a feeding part (the feeding part 510 of FIG. 5) and a ground part (the ground part 520 of FIG. 5), a first switching circuitry (e.g., the ground switching circuitry 530 of FIG. 5) that is connected between the ground part and the first conductive member, a processor (e.g., the processor 1020 of FIG. 1) that controls the first switching circuitry, and a communication circuitry (e.g., the communication module 1090 of FIG. 1) that processes a signal transmitted/received to/from an external device through the first conductive member. A first point of the first conductive member may be connected to the feeding part, a second point of the first conductive member may be selectively connected to the ground part depending on a switching operation of the first switching circuitry, and the closed-loop pattern may be connected to the second point.

According to various embodiments, the electronic device (e.g., the electronic device 100 of FIGS. 2A and 2B) may further include a plurality of matching elements that are connected between the first switching circuitry and the ground part, and the processor may control the first switching circuitry to connect at least one of the plurality of matching elements to the second point.

According to various embodiments, each of the plurality of matching elements may include a first end and a second end, the first end may be connected to the ground part, and the second end may be connected to the first switching circuitry. The feeding part may be connected to the first point through a second switching circuitry. The processor may control the first switching circuitry and the second switching circuitry to change a frequency band in which the first conductive member resonates.

According to various embodiments, the closed-loop pattern may be mounted on a support member that is disposed adjacent to the board.

According to various embodiments, the support member may be disposed substantially in parallel with the board, and the closed-loop pattern may be formed on a first surface of the support member. A first portion of the closed-loop pattern may penetrate the support member, and a second portion of the closed-loop pattern may be connected with the first portion and may form a contact part on a second surface of the support member. The second portion may be connected to a contact point of the board through a first connection member.

According to various embodiments, the second portion may be connected to a contact point of the board through a first connection member.

According to various embodiments, the electronic device may further include a connector for communication with an external device, and an additional matching element connected between the connector and the second point.

According to various embodiments, the electronic device may further include a display, and the closed-loop pattern may be formed substantially in parallel with an active region of the display.

According to various embodiments, the electronic device may further include a second conductive pattern, a third conductive pattern, a first nonconductive member, and a second nonconductive member formed on a side of the housing. The first nonconductive member may be interposed between the first conductive member and the second conductive member, and the second nonconductive member may be interposed between the first conductive member and the third conductive member.

According to various embodiments, the first conductive member and the second conductive member may be implemented with a c-clip, a connector, or a pogo pin.

According to various embodiments, a sound output module may be mounted on the support member.

An electronic device (e.g., the electronic device 100 of FIGS. 2A and 2B) according to various embodiments may include a housing (e.g., the housing 110 of FIGS. 2A and 2B), a first conductive member (e.g., the first conductive member 210 of FIGS. 2A and 2B) that is exposed through at least a part of the housing and forms an electrical path for wireless communication, a board (e.g., the first board 250 of FIG. 3) that includes a feeding part, a ground part, and a closed-loop pattern (e.g., the closed-loop pattern 295 of FIG. 5) connected to the first conductive member, a first switching circuitry that is connected between the ground part and the first conductive member, a processor (e.g., the processor 1020 of FIG. 1) that controls the first switching circuitry, and a communication circuitry (e.g., the communication module 1090) that processes signals which are transmitted/received to/from an external device through the first conductive member. A first point of the first conductive member may be connected to the feeding part, a second point of the first conductive member may be selectively connected to the ground part, and the closed-loop pattern may be connected to the second point.

According to various embodiments, the electronic device (e.g., the electronic device 100 of FIGS. 2A and 2B) may further include a support member on which the closed-loop pattern is mounted, and the support member may be disposed substantially in parallel with the board.

According to various embodiments, the electronic device may further include a display, and the closed-loop pattern may be formed substantially in parallel with an active region of the display.

Each of components (e.g., a module or a program) may include a single entity or a plurality of entities; some of the above-described corresponding sub components may be omitted, or any other sub component may be further included in various embodiments. Alternatively additionally, some components (e.g., a module or a program) may be combined with each other so as to form one entity, so that the functions of the components may be performed in the same manner as before the combination. According to various embodiments, operations executed by modules, program modules, or other components may be executed by a successive method, a parallel method, a repeated method, or a heuristic method. Alternatively, at least some of the operations may be executed in another order or may be omitted, or any other operation may be added.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

a housing including a first plate, a second plate facing away from the first plate, and a side member surrounding a space between the first plate and the second plate, the side member including:

a first conductive portion, a second conductive portion, a third conductive portion, wherein the first conductive portion is interposed between the second conductive portion and the third conductive portion, a first insulating portion interposed between the first conductive portion and the second conductive portion, and a second insulating portion interposed between the first conductive portion and the third conductive portion;

a wireless communication circuitry electrically connected to a first point of the first conductive portion for feeding, wherein the first point is adjacent to the second insulating portion;

a ground member included in the housing;

a first switching circuitry including a first terminal electrically connected to a second point of the first conductive portion, which is more distant from the second insulating portion than the first point, and at least one second terminal electrically connected to the ground member through at least one first passive element; and a conductive pattern electrically connected to the second point and forming a closed loop.

2. The electronic device of claim 1, wherein the wireless communication circuitry is configured to:

transmit and receive a signal having a frequency between 1700 MHz to 2200 MHz.

3. The electronic device of claim 1, further comprising:

a second switching circuitry including a third terminal electrically connected to the wireless communication circuitry, and at least one fourth terminal electrically connected to the first point through at least one second passive element or at least one active element.

4. The electronic device of claim 3, wherein the second passive element includes at least one of an inductor, a capacitor, or a resistor.

5. The electronic device of claim 3, wherein the active element includes at least one of a transistor or a diode.

6. The electronic device of claim 1, wherein the first passive element includes at least one of an inductor, a capacitor, or a resistor.

7. The electronic device of claim 1, further comprising:

a speaker module mounted adjacent to the first conductive portion inside the housing, wherein, when viewed from above the second plate, the conductive pattern overlaps at least a part of the speaker module.

8. An electronic device comprising:

a housing:

a first conductive member formed on a side of the housing;

a closed-loop pattern disposed inside the housing;

a board including a feeding part and a ground part;

a first switching circuitry connected between the ground part and the first conductive member;

a processor configured to control the first switching circuitry; and a communication circuitry configured to process a signal transmitted/received to/from an external device through the first conductive member, wherein a first point of the first conductive member is connected to the feeding part, wherein a second point of the first conductive member is selectively connected to the ground part depending on a switching operation of the first switching circuitry, and wherein the closed-loop pattern is connected to the second point.

9. The electronic device of claim 8, further comprising:

a plurality of matching elements connected between the first switching circuitry and the ground part, wherein the processor controls the first switching circuitry to connect at least one of the plurality of matching elements to the second point.

10. The electronic device of claim 9, wherein each of the plurality of matching elements includes a first end and a second end, and wherein each of the first ends are connected to the ground part, and each of the second ends are connected to the first switching circuitry.

11. The electronic device of claim 9, wherein the feeding part is connected to the first point through a second switching circuitry.

12. The electronic device of claim 11, wherein the processor is configured to:

control the first switching circuitry and the second switching circuitry to change a frequency band in which the first conductive member resonates.

13. The electronic device of claim 8, wherein the closed-loop pattern is disposed on a support member which is disposed adjacent to the board.

14. The electronic device of claim 13, wherein the support member is disposed substantially in parallel with the board, and wherein the closed-loop pattern is formed on a first surface of support member.

15. The electronic device of claim 14, wherein a first portion of closed-loop pattern penetrates the support member, and wherein a second portion of the closed-loop pattern is connected with the first portion and forms a contact part on a second surface of the support member.

16. The electronic device of claim 15, wherein the second portion is connected to a contact point of the board through a first connection member.

17. The electronic device of claim 16, wherein the second point of the first conductive member is connected to the contact point of the board through a second connection member.

18. The electronic device of claim 8, further comprising:

a connector for communication with an external device; and an additional matching element connected between the connector and the second point.

19. The electronic device of claim 8, further comprising:

a display, wherein the closed-loop pattern is formed substantially in parallel with an active region of the display.

20. The electronic device of claim 8, further comprising:

a second conductive pattern, a third conductive pattern, a first nonconductive member, and a second nonconductive member formed on a side of the housing, wherein the first nonconductive member is interposed between the first conductive member and a second conductive member, and wherein the second nonconductive member is interposed between the first conductive member and a third conductive member.

* * * * *